US008298356B2

(12) United States Patent
Ikeda et al.

(10) Patent No.: US 8,298,356 B2
(45) Date of Patent: Oct. 30, 2012

(54) ULTRAHIGH-STRENGTH STEEL SHEET EXCELLENT IN HYDROGEN EMBRITTLEMENT RESISTANCE AND WORKABILITY, AND MANUFACTURING METHOD THEREFOR

(75) Inventors: Muneaki Ikeda, Kakogawa (JP); Yukihiro Utsumi, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 337 days.

(21) Appl. No.: 12/610,727

(22) Filed: Nov. 2, 2009

(65) Prior Publication Data

US 2010/0132848 A1 Jun. 3, 2010

(30) Foreign Application Priority Data

Nov. 28, 2008 (JP) ..... 2008-304626

(51) Int. Cl.
*C21D 11/00* (2006.01)
*C22C 38/00* (2006.01)

(52) U.S. Cl. ..... 148/507; 148/320; 148/337; 148/651

(58) Field of Classification Search ..... 148/320, 148/331–337, 507, 651; 420/83, 89–93, 420/104–113, 117–121, 123–128
See application file for complete search history.

(56) References Cited

U.S. PATENT DOCUMENTS

| | | | |
|---|---|---|---|
| 6,537,394 | B1 | 3/2003 | Osawa et al. |
| 7,118,809 | B2 | 10/2006 | Utsumi et al. |
| 2009/0025831 | A1 | 1/2009 | Yamamoto et al. |
| 2009/0238713 | A1 | 9/2009 | Kinugasa et al. |
| 2010/0080728 | A1 | 4/2010 | Ikeda et al. |

FOREIGN PATENT DOCUMENTS

| | | | |
|---|---|---|---|
| CN | 1990894 | A | 7/2007 |
| EP | 1 512 762 | A1 | 3/2005 |
| EP | 1 514 951 | A1 | 3/2005 |
| EP | 1 676 932 | A1 | 7/2006 |
| EP | 1 978 113 | A1 | 10/2008 |
| EP | 2 180 075 | A1 | 4/2010 |
| JP | 3-277743 | | 12/1991 |
| JP | 3254108 | | 11/2001 |
| JP | 2001-335890 | | 12/2001 |
| JP | 2005-154872 | | 6/2005 |
| JP | 2005-171321 | | 6/2005 |
| JP | 2008-169475 | | 7/2008 |

OTHER PUBLICATIONS

U.S. Appl. No. 12/513,514, filed May 5, 2009, Ikeda, et al.

(Continued)

*Primary Examiner* — Stanley Silverman
*Assistant Examiner* — Brian Walck
(74) *Attorney, Agent, or Firm* — Oblon, Spivak, McClelland, Maier & Neustadt, L.L.P.

(57) ABSTRACT

The ultrahigh-strength steel sheet contains, in mass %, C: 0.05-0.25%, Si: 1.00-2.5%, Mn: 2.0-4.0%, P: 0.1% or below (not inclusive of 0%), S: 0.05% or below (not inclusive of 0%), Al: 0.01-0.15%, Ti: 0.003-0.10%, N: 0.01% or below (not inclusive of 0%), the balance comprising iron with inevitable impurities, and is a composite structure steel sheet comprising 10-50 area % ferrite and 50 area % or above martensite, in which the average circle-equivalent grain diameter of ferrite grains is 2.0 μm or below, the average aspect ratio of ferrite grains is 2.0 or below, and the tensile strength is 1,100 MPa or above. Accordingly, the ultrahigh-strength steel sheet is excellent in hydrogen embrittlement resistance and workability.

9 Claims, 1 Drawing Sheet

OTHER PUBLICATIONS

Office Action issued May 25, 2011, in China Patent Application No. 200910246387.8 (with English translation).

M. Zhang, "Continuous cooling transformation diagrams and properties of micro-alloyed TRIP steels", Materials Science and Engineering A, vol. 438-440, XP025099386, Nov. 25, 2006, pp. 296-299.

Korean Office Action issued Aug. 17, 2011, in Patent Application No. 2009-0115090.

Yuuji Kimura, et al., "Influence of Prior Austenite Grain Refinement on Delayed Fracture Properties of a 1400MPa Class High Strength Steel", National Institute for Materials Science, CAMP-ISIJ vol. 14, 2001, 1 page.

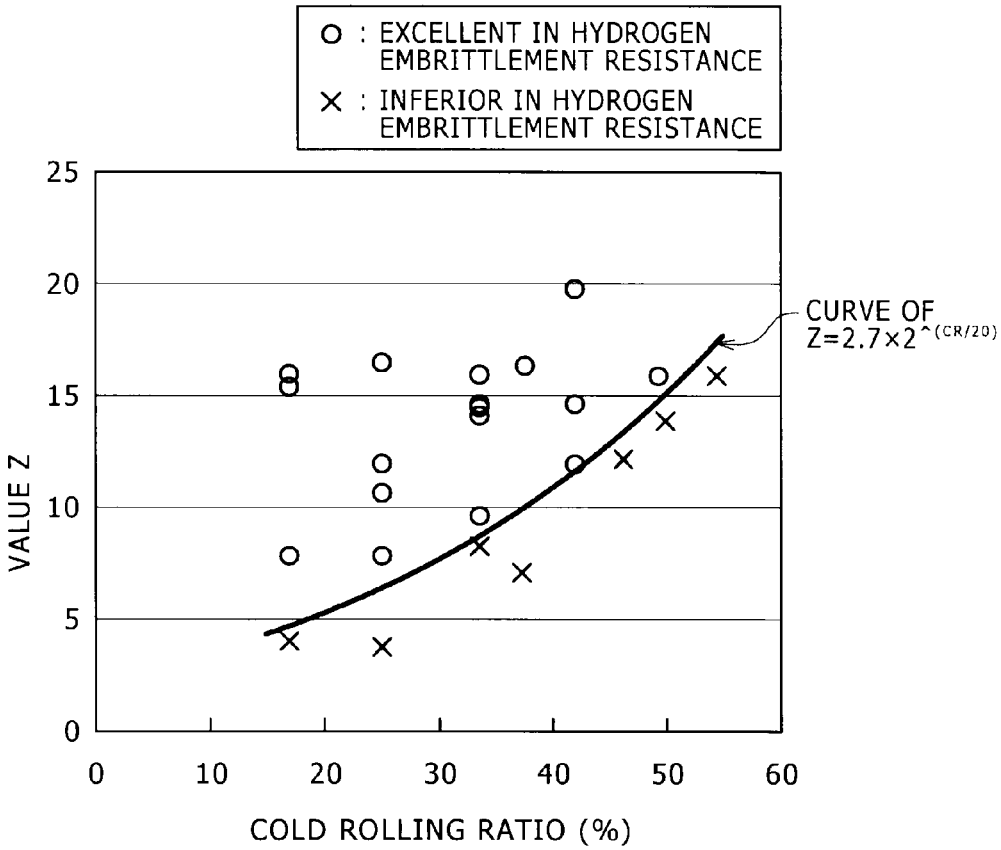
○ : EXCELLENT IN HYDROGEN EMBRITTLEMENT RESISTANCE
× : INFERIOR IN HYDROGEN EMBRITTLEMENT RESISTANCE
CURVE OF Z=2.7×2^(CR/20)
VALUE Z
COLD ROLLING RATIO (%)
0
5
10
15
20
25
0
10
20
30
40
50
60

ULTRAHIGH-STRENGTH STEEL SHEET EXCELLENT IN HYDROGEN EMBRITTLEMENT RESISTANCE AND WORKABILITY, AND MANUFACTURING METHOD THEREFOR

FIELD OF THE INVENTION

The present invention relates to an ultrahigh-strength steel sheet with 1,100 MPa or above tensile strength suitable to a steel sheet for automotive use and excellent in hydrogen embrittlement resistance and workability.

BACKGROUND OF THE INVENTION

In recent years, in order to realize low fuel consumption of an automobile, it is strongly desired to make the automobile light in weight, and a high-strength steel sheet is required from such a viewpoint. From another viewpoint of improving safety performance against a collision also, for a structural member for automotive use such as a rocker, for example, ultrahigh strengthening as high as 1,100 MPa or above is required. In such an ultrahigh-strength steel sheet, a problem of hydrogen embrittlement occurs by infiltration of hydrogen generated by corrosion reaction under an environment including water, hydrogen sulfide and the like.

Also, in a galvanized steel sheet performed with hot-dip galvanizing or alloyed hot-dip galvanizing because of the rust prevention requirements, hydrogen embrittlement occurs by performance of hot-dip galvanizing or alloyed hot-dip galvanizing because of hydrogen occluded in pickling after hot rolling. In a galvanized steel sheet also, the hydrogen embrittlement problem becomes conspicuous in an ultrahigh-strength area of 1,100 MPa or above tensile strength in particular.

Further, although bending workability is required for a steel sheet for automotive use, as the steel sheet is high strengthened, bending workability tends to be deteriorated, therefore a technology for securing excellent bending workability even in an ultrahigh-strength area of 1,100 MPa or above is required.

With regard to the documents related to the ultrahigh-strength steel sheet, the Japanese Patent No. 3,254,108, for example, discloses a 1,180 MPa or above ultrahigh-strength steel sheet with improved hydrogen embrittlement resistance containing compositions such as Ca, Cr, Ni and Cu. Also, "Effect of old γ grains refinement on delayed fracture resistance of 1,400 MPa class high-strength steel" by Yuji Kimura and 4 others, CAMP-ISIJ, Vol. 14 (2001)-1310 discloses that control (refinement) of the grain diameter of old austenite grains is effective in improving delayed fracture resistance of 1,400 MPa class steel.

Also, the Japanese Unexamined Patent Application Publication No. 2005-171321 discloses a 980 MPa or above high-strength steel sheet whose formability and bending workability are improved by optimizing the grain diameter of ferrite and the fraction and hardness of a low temperature transformation formation phase, although 1,100 MPa or above ultrahigh-strength level is not a direct object of the patent.

In both the documents, either one of hydrogen embrittlement resistance and bending workability is watched, but an ultrahigh-strength steel sheet in which both characteristics of hydrogen embrittlement resistance and bending workability are improved is not disclosed.

SUMMARY OF THE INVENTION

The present invention was developed considering such circumstances, and its purpose is to provide an ultrahigh-strength steel sheet with 1,100 MPa or above tensile strength excellent in hydrogen embrittlement resistance and workability (bending workability, in particular), and a manufacturing method therefor.

The steel sheet of the present invention that could solve the problems described above contains: C: 0.05-0.25% (means mass %, hereinafter the same with respect to the chemical componential composition), Si: 1.00-2.5%, Mn: 2.0-4.0%, P: 0.1% or below, S: 0.05% or below, Al: 0.01-0.15%, Ti: 0.003-0.10%, N: 0.01% or below, the balance comprising iron with inevitable impurities, and is a composite structure steel sheet comprising ferrite and martensite, in which ferrite is 10-50 area % and martensite is 50 area % or above, the average circle-equivalent grain diameter of ferrite grains is 2.0 μm or below and the average aspect ratio of ferrite grains is 2.0 or below, and tensile strength is 1,100 MPa or above.

The ultrahigh-strength steel sheet of the present invention may further contain, according to the necessity, (a) Nb: 0.003-0.20% and/or V: 0.003-0.20%, and the total of Ti, Nb and V content is 0.25% or below, (b) at least one kind selected from a group comprising Cu: 0.01-1.0%, Ni: 0.01-1.0%, and Cr: 0.01-1.0%, (c) Mo: 0.01-1.0% and/or W: 0.01-1.0%, (d) B: 0.0001-0.005%, and (e) at least one kind selected from a group comprising Ca: 0.0005-0.005%, Mg: 0.0005-0.005%, and REM: 0.0005-0.005%.

The present invention also includes an ultrahigh-strength steel sheet performed with hot-dip galvanizing or alloyed hot-dip galvanizing.

Further, the present invention also includes a manufacturing method for the ultrahigh-strength steel sheet, in which a hot rolled steel sheet satisfying any of the componential compositions described above is cold rolled so that X expressed by an equation (1) below satisfies $X \geqq 0$ and a cold rolling ratio CR(%) becomes CR<50%, and is thereafter subjected to soaking treatment at $(A_{C1}+50)°$ C. to 900° C.

$$X = 20\left([\mathrm{Ti}] + \frac{[\mathrm{Nb}]}{2} + \frac{[\mathrm{V}]}{4}\right) - 9[\mathrm{Si}] + 7[\mathrm{Mn}] + 10 - 2.7 \times 2^{\frac{CR}{20}} \quad (1)$$

where, [Ti], [Nb], [V], [Si], [Mn] respectively represent the content (mass %) of each element.

In the present invention, because the grain diameter and the aspect ratio of ferrite grains are appropriately controlled, an ultrahigh-strength steel sheet excellent in both hydrogen embrittlement resistance and bending workability can be provided. Also, in the ultrahigh-strength steel sheet in relation with the present invention, because the fraction of ferrite and martensite is appropriately controlled, both ultrahigh-strength and excellent elongation can be realized.

BRIEF DESCRIPTION OF THE DRAWING

FIG. 1 is a graph showing the relation between the cold rolling ratio CR(%) and the value Z (=20([Ti]+[Nb]/2+[V]/4)−9[Si]+7[Mn]+10).

DETAILED DESCRIPTION OF THE PREFERRED EMBODIMENTS

As described above, in the ultrahigh-strength area of 1,100 MPa or above, deterioration of hydrogen embrittlement resistance and bending workability appear, however a technology that can solve both of them has not been disclosed. Under such circumstances, the inventors have made intensive studies in order to improve both hydrogen embrittlement resistance and bending workability in a 1,100 MPa or above ultra-high-strength composite structure steel sheet containing ferrite and martensite, with paying attention especially to ferrite grains. As a result, it was found out that hydrogen embrittlement resistance could be improved by controlling not only the grain diameter of ferrite grains but also the aspect ratio, and that controlling of the aspect ratio of the ferrite grains could also improve bending workability at the same time, and the present invention has been developed.

Thus, the present invention is characterized in that the ultrahigh-strength steel sheet in which both of hydrogen embrittlement resistance and bending workability are improved can be provided by controlling a variety of componential compositions and controlling the grain diameter and the aspect ratio of ferrite grains. Further, in the document "Effect of old γ grains refinement on delayed fracture resistance of 1,400 MPa class high-strength steel" referred to above, the fact that refinement of old γ grains is effective in improving delayed fracture resistance is described, however, according to the result of the investigation by the inventors, it was found out that, in order to secure a desired performance, refinement of the structure was not enough, and appropriate control of the form of ferrite (not only the grain diameter but the aspect ratio should be included) was extremely important, and the present invention has been completed.

Below, the form of ferrite (the average circle-equivalent grain diameter and the aspect ratio) that is the feature of the steel sheet of the present invention will be described.

With respect to the average circle-equivalent grain diameter (hereinafter referred to as "the average grain diameter") of ferrite grains, as the average grain diameter of ferrite grains becomes smaller, hydrogen embrittlement resistance is improved. In order to exert such effect sufficiently, the average grain diameter of ferrite grains was set to 2.0 μm or below. The smaller the average grain diameter of ferrite grains is, the better, which is preferably 1.9 μm or below, more preferably 1.7 μm or below. Although there is no lower limit in particular for the average grain diameter of ferrite grains, it may be approximately 1.0 μm.

Also, the aspect ratio (major axis/minor axis) of ferrite grains is a factor affecting hydrogen embrittlement resistance and bending workability. As the aspect ratio becomes larger, the local stress becomes higher, a starting point of a crack is easily generated, and both hydrogen embrittlement resistance and bending workability deteriorate. Therefore, the average aspect ratio of ferrite grains was set to 2.0 or below. The smaller the average aspect ratio of ferrite grains is, the better, which preferably is 1.7 or below, more preferably 1.5 or below. There is no lower limit in particular for the average aspect ratio of ferrite grains, and it may be approximately 1.0.

The ultrahigh-strength steel sheet of the present invention is a composite structure steel sheet comprising ferrite and martensite. While ferrite has an action of improving ductility, it causes lowering of strength when it becomes excessive. While martensite has an action of improving strength, it causes lowering of ductility when it becomes excessive. Therefore, from the viewpoint of improving both strength and ductility with a good balance, it was set that, in the space factor to the whole structure, ferrite should be 10-50 area % and martensite should be 50 area % or above. Ferrite is preferably 15-45 area %, more preferably 20-40 area %. Martensite is preferably 55-85 area %, more preferably 60-80 area %.

The ultrahigh-strength steel sheet of the present invention may consist of only ferrite and martensite, however, it may contain other structures (retained austenite, bainite, pseudo-pearlite, and the like) within the scope not inhibiting the effect of the present invention. In particular, retained austenite can improve hydrogen embrittlement resistance, therefore it would be preferable to contain by approximately 1-5 area %. Structures other than ferrite and martensite are preferably made 15 area % or below in total.

Next, chemical components in steel of the present invention will be described below.

C: 0.05-0.25%

C is an element effective in improving quenchability and high strengthening of steel. Therefore C content was set to 0.05% or above. C content is preferably 0.07% or above, more preferably 0.09% or above. On the other hand, when C content becomes excessive, hydrogen embrittlement resistance deteriorates. Therefore, C content was set to 0.25% or below. C content is preferably 0.2% or below, more preferably 0.17% or below.

Si: 1.00-2.5%

Si contributes to strengthening steel as a solid solution strengthening element, and is an element effective in improving ductility. Also, it has an action of inhibiting generation of cementite that becomes a starting point of a crack by hydrogen embrittlement. Therefore Si content was set to 1.00% or above. Si content is preferably 1.2% or above, more preferably 1.4% or above. On the other hand, when Si content becomes excessive, plating performance deteriorates. Therefore Si content was set to 2.5% or below. Si content is preferably 2.3% or below, more preferably 2.1% or below.

Mn: 2.0-4.0%

Mn is an element effective in improving quenchability and high strengthening of steel. In order to exert such actions effectively, Mn content was set to 2.0% or above. Mn content is preferably 2.2% or above, more preferably 2.4% or above. On the other hand, when Mn content becomes excessive, plating performance deteriorates and segregation becomes conspicuous. Therefore, Mn content was set to 4.0% or below. Mn content is preferably 3.5% or below, more preferably 3% or below.

P: 0.1% or below

Because P is an element promoting grain boundary embrittlement by segregating on a grain boundary, it is preferable to be minimized. Therefore P content was set to 0.1% or below. It is preferable to minimize P content, which is preferably 0.05% or below, more preferably 0.03% or below.

S: 0.05% or below

Because S promotes hydrogen absorption by steel under a corrosive environment and forms sulfide such as MnS which becomes a starting point of a crack by hydrogen embrittlement, it is preferable to be minimized. Therefore, S content was set to 0.05% or below. It is preferable to minimize S content, which is preferably 0.01% or below, more preferably 0.005% or below.

Al: 0.01-0.15%

Al is an element having a deoxidizing action. Also, it has an action of improving corrosion resistance and an action of improving hydrogen embrittlement resistance. Therefore, Al content was set to 0.01% or above. Al content is preferably 0.02% or above, and more preferably 0.03% or above. On the other hand, when Al content becomes excessive, deterioration of toughness and deterioration of workability by an inclusion such as alumina become a problem. Therefore, Al content was set to 0.15% or below. Al content is preferably 0.1% or below, more preferably 0.07% or below.

Ti: 0.003-0.10%

Ti is an element refining the structure and contributing to improve hydrogen embrittlement resistance by formation of carbide. Therefore, Ti content was set to 0.003% or above. Ti content is preferably 0.005% or above, more preferably 0.01% or above. On the other hand, when Ti content becomes excessive, the aspect ratio of ferrite grains becomes high and deterioration of hydrogen embrittlement resistance and workability is caused. Therefore, Ti content was set to 0.10% or below. Ti content is preferably 0.09% or below, more preferably 0.08% or below.

N: 0.01% or below

Although N is an element inevitably mixed-in in manufacturing, it is preferable to be minimized because, when N content becomes excessive, in addition to deterioration of workability, it is combined with B to form BN and inhibits quenching enhancing action of B. Therefore N content was set to 0.01% or below. It is preferable to minimize N content, which is preferably 0.008% or below, more preferably 0.006% or below.

Basic components of the steel used in the present invention are as described above, and the balance substantially is iron. However, inclusion in steel of inevitable impurities brought in by the situation of raw material, manufacturing materials, manufacturing equipment and the like is of course allowable. Also, the steel used in the present invention may include selective elements described below according to the necessity.

Nb: 0.003-0.20% and/or V: 0.003-0.20%, and total content of Ti, Nb and V is 0.25% or below Similar to Ti described above, Nb and V are elements contributing to improving hydrogen embrittlement resistance by refinement of the structure and formation of carbide. Therefore, Nb content is preferably 0.003% or above, and V content is preferably 0.003% or above. Nb content is more preferably 0.005% or above, further more preferably 0.01% or above. V content is more preferably 0.005% or above, further more preferably 0.01% or above. On the other hand, when Nb content and V content become excessive, the aspect ratio of ferrite grains becomes high and causes deterioration of hydrogen embrittlement resistance and bending workability. Therefore, Nb content is preferably 0.20% or below and V content is preferably 0.20% or below. Nb content is more preferably 0.18% or below, further more preferably 0.15% or below. V content is more preferably 0.18% or below, further more preferably 0.15% or below. Further, even when content of each element of Ti, Nb and V is individually controlled, the aspect ratio of ferrite grains may possibly become high to deteriorate hydrogen embrittlement resistance and bending workability, therefore the total content of Ti, Nb and V is preferably made 0.25% or below. The total content of Ti, Nb and V is more preferably 0.2% or below, further more preferably 0.16% or below.

At least one kind selected from a group comprising Cu: 0.01-1.0%, Ni: 0.01-1.0%, and Cr: 0.01-1.0%

All of Cu, Ni and Cr are elements contributing to improve hydrogen embrittlement resistance. Among them, Cu and Ni can sufficiently inhibit generation of hydrogen which causes hydrogen embrittlement and can inhibit infiltration of generated hydrogen to a steel sheet, therefore they are effective in improving hydrogen embrittlement resistance. In order to sufficiently exert such actions, Cu content is preferably 0.01% or above, and Ni content is preferably 0.01% or above. Cu content is more preferably 0.05% or above, further more preferably 0.1% or above. Ni content is more preferably 0.05% or above, further more preferably 0.1% or above. Also, by co-existence of Cu and Ni, the effects described above are exerted more effectively. On the other hand, when Cu content and Ni content become excessive, bending workability deteriorates. Therefore, Cu content is preferably 1.0% or below, and Ni content is preferably 1.0% or below. Cu content is more preferably 0.7% or below, further more preferably 0.5% or below. Ni content is more preferably 0.7% or below, further more preferably 0.5% or below. On the other hand, remaining Cr inhibits infiltration of hydrogen, and a precipitate containing Cr becomes a trap site for hydrogen, therefore Cr is effective in improving hydrogen embrittlement resistance. In addition, Cr is effective in improving the strength of a steel sheet. In order to sufficiently exert such effects, Cr content is preferably 0.01% or above. Cr content is more preferably 0.05% or above, further more preferably 0.1% or above. On the other hand, when Cr content becomes excessive, ductility and bending workability deteriorate. Therefore, Cr content is preferably 1.0% or below. Cr content is more preferably 0.7% or below, further more preferably 0.5% or below.

Mo: 0.01-1.0% and/or W: 0.01-1.0%

Both Mo and W are elements contributing to improve hydrogen embrittlement resistance. More specifically, Mo is an element effective in securing retained austenite by stabilizing austenite, and improving hydrogen embrittlement resistance by inhibiting infiltration of hydrogen. Also, Mo is an element effective in improving quenchability of a steel sheet. In order to effectively exert such effects, Mo content is preferably 0.01% or above. Mo content is more preferably 0.03% or above, further more preferably 0.05% or above. On the other hand, even if Mo content becomes excessive, the effects described above are saturated and the cost increases. Therefore, Mo content is preferably 1.0% or below. Mo content is more preferably 0.7% or below, further more preferably 0.5% or below. Further, W is an element effective, in addition to those described above, in improving the strength of a steel sheet. Furthermore, a precipitate containing W becomes a trap site for hydrogen, therefore W is effective in improving hydrogen embrittlement resistance. In order to effectively exert such effects, W content is preferably 0.01% or above. W content is more preferably 0.1% or above, further more preferably 0.2% or above. On the other hand, when W content becomes excessive, ductility and bending workability deteriorate. Therefore W content is preferably 1.0% or below. W content is more preferably 0.7% or below, further more preferably 0.5% or below.

B: 0.0001-0.005%

B is an element effective in improving the strength of a steel sheet by improving quenchability. In order to exert such effects, B content is preferably 0.0001% or above. B content is more preferably 0.0002% or above, further more preferably 0.0005% or above. On the other hand, when B content becomes excessive, hot workability deteriorates. Therefore, B content is preferably 0.005% or below. B content is more preferably 0.003% or below, further more preferably 0.002% or below.

At least one kind selected from a group comprising Ca: 0.0005-0.005%, Mg: 0.0005-0.005%, and REM: 0.0005-0.005%

Ca, Mg and REM are elements effective in improving corrosion resistance of a steel sheet by inhibiting increase of hydrogen ion concentration in a boundary face accompanying corrosion of the surface of the steel sheet, i.e. by inhibiting a drop of pH. In order to exert such effects sufficiently, it is preferable to make Ca content 0.0005% or above, Mg content 0.0005% or above, and REM content 0.0005% or above. Ca content is more preferably 0.0007% or above, further more preferably 0.0009% or above. Mg content is more preferably 0.0007% or above, further more preferably 0.001% or above. REM content is more preferably 0.001% or above, further more preferably 0.002% or above. On the other hand, when each Ca, Mg and REM content becomes excessive, bending workability deteriorates. Therefore, it is preferable to make Ca content 0.005% or below, Mg content 0.005% or below, and REM content 0.005% or below. Ca content is more preferably 0.003% or below, further more preferably 0.002% or below. Mg content is more preferably 0.004% or below, further more preferably 0.003% or below. REM content is more preferably 0.0045% or below, further more preferably 0.004% or below. Here, REM means 17 elements in total. They are lanthanoid, which is La of the atomic number 57 through to Lu of the atomic number 71, and Sc of the atomic number 21 and Y of the atomic number 39.

The ultrahigh-strength steel sheet of the present invention includes a galvanized steel sheet performed with galvanizing, in addition to a cold rolled steel sheet performed with cold rolling after hot rolling. The galvanized steel sheet includes both a hot-dip galvanized steel sheet and an alloyed hot-dip galvanized steel sheet. The cold rolled steel sheet satisfying the requirements described above is especially useful as a steel sheet for galvanizing, and, according to the present invention, a cold rolled steel sheet, a hot-dip galvanized steel sheet, and an alloyed hot-dip galvanized steel sheet excellent in both hydrogen embrittlement resistance and bending workability can be obtained.

Next, a manufacturing method for an ultrahigh-strength steel sheet in relation with the present invention satisfying the requirements referred to above will be described.

In order to manufacture a steel sheet of the present invention, it is especially important (i) to perform cold rolling with a cold rolling ratio being made below a predetermined value, and with the relation between the cold rolling ratio and Ti, Nb, V, Si, Mn content being controlled to an appropriate range (these may be hereinafter collectively referred to as "the cold rolling condition"), and (ii) to control the soaking temperature after cold rolling to a predetermined range. More specifically, a hot rolled steel sheet satisfying the componential compositions described above is cold rolled so that X expressed by an equation (1) below satisfies $X \geqq 0$ and a cold rolling ratio CR(%) becomes CR<50%, and the cold rolled steel sheet obtained by the cold rolling is performed with soaking treatment at $(A_{C1}+50)°$ C. to 900° C.

$$X = 20\left([\mathrm{Ti}] + \frac{[\mathrm{Nb}]}{2} + \frac{[\mathrm{V}]}{4}\right) - 9[\mathrm{Si}] + 7[\mathrm{Mn}] + 10 - 2.7 \times 2^{\frac{CR}{20}} \quad (1)$$

where, [Ti], [Nb], [V], [Si], [Mn] respectively represent the content (mass %) of each element.

Further, the steel sheet of the present invention also includes a hot-dip galvanized steel sheet and an alloyed hot-dip galvanized steel sheet performed with galvanizing, however, required characteristics can be obtained as far as above (i) and (ii) before galvanizing are appropriately controlled, and it has been confirmed that a galvanizing process(es) thereafter does not make a difference.

Below, each requirement characterizing the manufacturing method of the present invention will be described in detail.

X expressed by the equation (1) satisfies and a cold rolling ratio CR(%)<50%

The equation (1) was determined by a number of basic experiments by the inventors as a parameter contributing especially to refinement of the average grain diameter of ferrite grains. More specifically, the equation (1) was determined from the viewpoint that the elements constituting the equation (1) (Ti, Nb, V, Si, Mn) and the cold rolling ratio contribute to refinement of ferrite grains because of the points described below.

Below, how the equation (1) was determined will be described in detail.

In order to form fine ferrite structure, it is contemplated that inhibiting recrystallization of ferrite is effective. In this regard, recrystallization of ferrite can be inhibited either by (a) raising the recrystallization temperature of ferrite, or (b) lowering the $A_{C1}$ point and narrowing the temperature width from recrystallization starting temperature of ferrite to the $A_{C1}$ point. The reason is that in heating the steel sheet after cold rolling, if the steel sheet once enters into a two phase region, austenite is generated and recrystallization of ferrite is extremely inhibited. By (a) or (b) above, recrystallization temperature range from starting of recrystallization to two phase annealing can be narrowed, and recrystallization of ferrite can be inhibited.

In relation with the recrystallization temperature of (a) above, in the present invention, from the viewpoint that "recrystallization temperature is affected by Ti, Nb or V content and the cold rolling ratio CR", the equation including these factors was determined.

First, in order to raise the recrystallization temperature of ferrite, addition of Ti, Nb or V is effective. Therefore, their content has a plus (positive) factor in the equation (1). Although the steel sheet of the present invention includes Ti as an essential component and Nb, V as selective components, in the present invention, contribution ratios (factors) of Ti, Nb, V in the equation (1) were calculated from a number of basic experiments, therefore, it has been confirmed that, even in the case where the selective components of Nb, V are not contained at all, desired characteristics can be obtained as far as the value X defined by the equation (1) satisfies $X \geqq 0$. On the other hand, in order to raise the recrystallization temperature of ferrite, lowering of the cold rolling ratio CR is effective. The reason is that, by lowering the cold rolling ratio, accumulated strain energy decreases, therefore recrystallization driving force decreases and the recrystallization temperature rises. Accordingly, the cold rolling ratio CR has a minus (negative) factor in the equation (1), and, apart from the equation (1), "CR<50%" was stipulated. CR is preferably 45% or below, more preferably 40% or below.

In relation with the $A_{C1}$ point in (b) above, in order to lower the $A_{C1}$ point, inhibiting (reducing) Si content and increasing Mn content are effective. In other words, although the $A_{C1}$ point can be calculated by an equation (2) below ("The Physical Metallurgy of Steels" by Leslie), according to the equation (2), Si has a minus (negative) factor and Mn has a plus (positive) factor, therefore $A_{C1}$ point rises by addition of Si, whereas it is lowered by addition of Mn.

$$A_{C1}(°\,\mathrm{C.}) = 723 - 10.7 \times [\mathrm{Mn}] - 16.9 \times [\mathrm{Ni}] + 29.1 \times [\mathrm{Si}] + 16.9 \times [\mathrm{Cr}] + 6.38 \times [\mathrm{W}] \quad (2)$$

(where, [(name of an element)] represents the content (mass %) of each element.)

The above can be summarized as follows. The equation (1) was determined because, in order to inhibit recrystallization of ferrite, after all, it is effective (a) in relation with Ti, Nb, V and the cold rolling ratio, which are the factors affecting recrystallization temperature, to contain Ti, Nb, or V and to reduce the cold rolling ratio, and (b) in relation with Mn, Si which are the factors affecting setting of the $A_{C1}$ point, to include Mn while inhibiting Si content.

In FIG. 1, the data of examples described below are plotted with an axis of abscissa representing the cold rolling ratio and an axis of ordinates representing Z [Z=20([Ti]+[Nb]/2+[V]/4)−9[Si]+7[Mn]+10]. Here the equation Z is given by deleting a parameter including the cold rolling ratio CR (2.7×2', α:CR/20) out of a right-hand side constituting the equation (1), and is constituted of parameters including Ti, Nb, V, Si, Mn only. In other words, the value Z is a value where the contents of respective elements are multiplied by respective factors according to the contribution degree to the recrystallization temperature of Ti, Nb, V and the contribution degree to the $A_{C1}$ point of Si, Mn, and are added together. From FIG. 1, it is known that, with the curve of Z=2.7×2, (α:CR/20) as a boundary, delayed fracture resistance is excellent in the region upper than the curve. Therefore, delayed fracture resistance can be made excellent by controlling a variety of componential compositions and the cold rolling ratio so as to satisfy Z≧2.7×2", (α:CR/20), i.e. X≧0.

Soaking Treatment at ($A_{C1}$+50)° C. to 900° C.

The reason the soaking temperature after cold rolling was determined as ($A_{C1}$+50)° C. or above was to secure martensite useful in high strengthening and to reduce the aspect ratio of ferrite grains useful in realizing both hydrogen embrittlement resistance and bending workability. If the soaking temperature is below ($A_{C1}$+50)° C., required martensite quantity cannot be surely secured. Also, in order to make the aspect ratio of ferrite grains a predetermined value or below, recrystallization should be proceeded with to some extent, and from such a viewpoint also, ($A_{C1}$+50)° C. or above was set. Further, as described above, austenite is generated if the soaking temperature exceeds the $A_{C1}$ point, therefore recrystallization of ferrite is inhibited compared to the case of the $A_{C1}$ point or below, but when compared to the case of the temperature higher than the $A_{C1}$ point, recrystallization becomes easy to progress as the temperature becomes higher. The lower limit of the soaking temperature is preferably ($A_{C1}$+60)° C., more preferably ($A_{C1}$+70)° C.

On the other hand, when the soaking temperature becomes excessively high, austenite grains become coarse. Therefore, the upper limit of the soaking temperature was set to 900° C. or below. Preferable soaking temperature is 880° C. or below.

Also, the soaking time is preferably 10-100 seconds, more preferably 30-80 seconds.

According to the present invention, it is important to appropriately control the cold rolling condition and the soaking temperature after cold rolling as described above, and other processes such as hot rolling, cooling and holding after soaking, for example, are not particularly limited, and can be performed according to ordinary methods. Further, in manufacturing a hot-dip galvanized steel sheet and an alloyed hot-dip galvanized steel sheet performed with galvanizing after cold rolling, their galvanizing conditions are not limited also, and the galvanizing conditions may be appropriately controlled so that the desired characteristics can be obtained.

Below, preferable processes of the present invention will be described in order.

First, steel satisfying the composition described above is prepared and is hot rolled. It is preferable to perform hot rolling by heating to 1,150-1,300° C. and rolling thereafter with the finishing temperature of 850-950° C.

Next, cold rolling and soaking are performed as described above.

After soaking, it is preferable to perform cooling to approximately 450-550° C. at an average cooling rate of approximately 1-100° C./sec, holding at the temperature of 450-550° C. for more than 1 second, and cooling thereafter to a room temperature at an average cooling rate of approximately 1-50° C./sec.

If galvanizing is to be performed, it is preferable to perform cooling to approximately 450-550° C. at an average cooling rate of approximately 1-100° C./sec after soaking, holding at the temperature of 450-550° C. for 1-200 seconds, immersing thereafter in a galvanizing bath (galvanizing bath temperature: approximately 400-500° C.), and cooling then to a room temperature at an average cooling rate of 1-50° C./sec.

If alloying is to be performed further, it is preferable to perform alloying at 500-600° C. for approximately 5-30 seconds after galvanizing. It is preferable to perform cooling to a room temperature at an average cooling rate of 1-50° C./sec after alloying.

EXAMPLES

Although the present invention will be explained below further specifically referring to examples, the present invention is not essentially to be limited by the examples below, and can of course be implemented with modifications added appropriately within the scope adaptable to the purposes described previously and later, and any of them is to be included within the technical range of the present invention.

The steel of the chemical components shown in Table 1 was smelted according to an ordinary smelting method, and was casted to obtain a slab. Then, it was heated to 1,250° C., was hot rolled (sheet thickness: 2.4 mm) at a finishing temperature of 880° C., was pickled thereafter, and was cold rolled respectively by the cold rolling ratios shown in Table 2 to obtain cold rolled sheets. Next, they were soakingly held at the soaking temperature shown in Table 2 for 50 seconds respectively, cooled to 500° C. at the average cooling rate of 10° C./sec, and were thereafter held at the temperature for 50 seconds. With respect to the hot-dip galvanized steel sheets (shown as "GI" in Table 2), the steel sheets were immersed thereafter in a galvanizing bath of 460° C., and were cooled then to a room temperature at the average cooling rate of 10° C./sec. With respect to the alloyed hot-dip galvanized steel sheets (shown as "GA" in Table 2), the steel sheets were performed further with an alloying treatment at 550° C. for 20 seconds after immersing in the galvanizing bath, and were cooled to a room temperature at the average cooling rate of 10° C./sec. With respect to the REM in Table 1, a mischmetal containing La: approximately 50%, Ce: approximately 30% was used.

TABLE 1

| Steel | Chemical componential composition | | | | | | | | | | |
|---|---|---|---|---|---|---|---|---|---|---|---|
| kind | C | Si | Mn | P | S | Al | Ti | N | Nb | V | Cu |
| A | 0.093 | 1.56 | 2.86 | 0.011 | 0.002 | 0.04 | 0.042 | 0.003 | | | |
| B | 0.094 | 1.82 | 2.62 | 0.012 | 0.001 | 0.05 | 0.059 | 0.005 | | | |
| C | 0.152 | 1.42 | 2.27 | 0.007 | 0.002 | 0.05 | 0.069 | 0.004 | | | |
| D | 0.092 | 1.21 | 2.51 | 0.007 | 0.001 | 0.04 | 0.081 | 0.003 | | | 0.32 |
| E | 0.089 | 2.14 | 2.85 | 0.011 | 0.001 | 0.04 | 0.051 | 0.004 | | 0.045 | |
| F | 0.168 | 2.25 | 2.12 | 0.015 | 0.002 | 0.05 | 0.032 | 0.004 | 0.131 | | |
| G | 0.134 | 2.48 | 2.41 | 0.009 | 0.002 | 0.04 | 0.088 | 0.005 | | | |
| H | 0.089 | 1.25 | 2.44 | 0.012 | 0.002 | 0.04 | 0.062 | 0.005 | | | |
| I | 0.120 | 0.34 | 3.20 | 0.007 | 0.002 | 0.05 | 0.089 | 0.004 | | | |
| J | 0.126 | 1.33 | 1.88 | 0.011 | 0.002 | 0.04 | 0.094 | 0.002 | | | |

TABLE 1-continued

| | | | | | | | | | | | |
|---|---|---|---|---|---|---|---|---|---|---|---|
| K | 0.130 | 1.90 | 2.50 | 0.011 | 0.001 | 0.05 | | 0.006 | | | |
| L | 0.082 | 1.87 | 2.78 | 0.022 | 0.002 | 0.07 | 0.081 | 0.005 | | | |
| M | 0.147 | 1.80 | 2.14 | 0.010 | 0.001 | 0.06 | 0.028 | 0.004 | | | |
| N | 0.115 | 1.13 | 2.45 | 0.008 | 0.001 | 0.03 | 0.092 | 0.003 | | | |
| O | 0.108 | 1.80 | 3.08 | 0.008 | 0.001 | 0.04 | 0.031 | 0.004 | 0.040 | | |
| P | 0.134 | 1.09 | 2.35 | 0.010 | 0.001 | 0.04 | 0.039 | 0.003 | | 0.051 | 0.12 |
| Q | 0.093 | 2.02 | 3.64 | 0.012 | 0.001 | 0.04 | 0.047 | 0.003 | 0.042 | | 0.21 |
| R | 0.095 | 1.41 | 2.90 | 0.007 | 0.002 | 0.04 | 0.030 | 0.004 | | | |
| S | 0.089 | 1.18 | 3.20 | 0.006 | 0.001 | 0.03 | 0.018 | 0.004 | | | |
| T | 0.064 | 1.43 | 2.37 | 0.014 | 0.003 | 0.07 | 0.130 | 0.003 | | | |
| U | 0.091 | 1.67 | 1.92 | 0.021 | 0.002 | 0.11 | 0.105 | 0.006 | | 0.183 | |
| V | 0.140 | 1.97 | 2.50 | 0.011 | 0.001 | 0.05 | 0.030 | 0.006 | | | |
| W | 0.130 | 1.90 | 2.50 | 0.011 | 0.001 | 0.05 | 0.009 | 0.006 | | | |
| X | 0.102 | 1.43 | 2.83 | 0.008 | 0.002 | 0.05 | 0.004 | 0.003 | | | |

| Steel | Chemical componential composition | | | | | | | | $Ac_1$ |
|---|---|---|---|---|---|---|---|---|---|
| kind | Ni | Cr | Mo | W | B | Ca | Mg | REM | (° C.) |
| A | | | | | | | | | 738 |
| B | | 0.21 | | | | | | | 751 |
| C | | 0.33 | | | | | 0.0012 | 0.0035 | 746 |
| D | 0.28 | | | | | | | | 727 |
| E | | | | | | | | | 755 |
| F | | 0.22 | | | | | | | 770 |
| G | | | | | 0.0013 | | | | 769 |
| H | | 0.14 | | 0.42 | | | | | 738 |
| I | | 0.32 | | | | | | | 704 |
| J | | | | | | | | | 742 |
| K | | 0.40 | | | | | | | 758 |
| L | | 0.21 | 0.05 | | | | | | 751 |
| M | | 0.36 | 0.09 | | | | | | 759 |
| N | | | 0.24 | | | | | | 730 |
| O | | 0.12 | | | | 0.0012 | | | 744 |
| P | 0.10 | 0.45 | | | | | | | 735 |
| Q | 0.15 | 0.08 | 0.34 | | | | | | 742 |
| R | | 0.23 | | | | | | | 737 |
| S | | | | | | | | | 723 |
| T | | 0.40 | 0.03 | | | | | | 746 |
| U | | 0.18 | 0.22 | | 0.0005 | | | | 754 |
| V | | 0.12 | | | | | | | 756 |
| W | | 0.40 | | | | | | | 758 |
| X | | 0.11 | | | | | | | 736 |

*Balance is iron and inevitable impurities.

(Measurement of Structure Fraction, Grain Diameter and Aspect Ratio of Ferrite Grains)

The steel sheet obtained as above was cut at a cross-section perpendicular to the sheet width direction, a measuring area of approximately 20 μm×20 μm in the vicinity of the t/4 position (t: sheet thickness) was observed by a SEM (scanning electron microscope) with a 4,000 times magnification, an image analysis was performed, and the fractions of martensite and ferrite were measured. With respect to the average grain diameter of ferrite grains, the average area of ferrite grains was obtained in one observation field of view, and its circle-equivalent diameter was made the average grain diameter of ferrite grains. With respect to the aspect ratio, five lines each were drawn at random in the vertical direction (sheet thickness direction) and the lateral direction (rolling direction) respectively in one observation field of view, the average of the length of the lines crossing the ferrite grains was obtained on respective vertical lines and lateral lines, and the average aspect ratio was obtained as (the average lateral line length)/(the average vertical line length). Measurement was conducted on five arbitrary fields of view, and the arithmetic average was obtained on the structure fraction, and the grain diameter and the aspect ratio of ferrite respectively.

(Measurement of Tensile Strength and Total Elongation)

A JIS No. 13 B test piece was taken from the steel sheet, and the tensile strength (TS) and the total elongation (EL) were measured in accordance with JIS Z 2241.

(Evaluation of Hydrogen Embrittlement Resistance)

Immediately after the JIS No. 13 B test piece was subjected to seven cycles of the CCT test of Japanese Automobile Standards (JASO), the SSRT (the test by Slow Strain Rate Technique method) was conducted (cross-head speed: 0.05 mm/min), a tensile load was applied to the test piece in the longitudinal axis direction, and the elongation was measured. The elongation reduction ratio was evaluated on before and after conducting the CCT test, and the case of 20% or below elongation reduction ratio was given o, whereas the case of exceeding 20% was given x.

(Measurement of Bending Workability)

The 90 degree V-bending tests were conducted so that the bending ridge line became perpendicular to the sheet width direction using 20 mm×70 mm size test pieces. The tests were conducted with the bending radius R being appropriately varied, and the minimum bending radius Rmin with which bending work could be performed without causing a crack in the test piece was obtained. The case the minimum bending radius Rmin became Rmin≦2.5t (t: sheet thickness) was deemed to have passed.

These results are shown in Table 2.

TABLE 2

| Steel sheet No. | Steel kind | Cold rolling ratio (%) | Value X | Soaking temperature (° C.) | $Ac_1$ + 50° C. | Galvanizing*1 | Area ratio(%) Ferrite | Area ratio(%) Martensite | TS (MPa) | EL (%) | Ferrite Aspect ratio | Ferrite Grain Diameter(μm) | Hydrogen embrittlement resistance | Bending workability |
|---|---|---|---|---|---|---|---|---|---|---|---|---|---|---|
| 1 | A | 33 | 5.7 | 830 | 788 | GA | 34 | 59 | 1179 | 14.2 | 1.1 | 1.6 | ○ | ○ |
| 2 | A | 33 | 5.7 | 780 | 788 | GA | 63 | 36 | 1145 | 12.1 | 2.4 | 1.8 | X | X |
| 3 | B | 25 | 4.2 | 840 | 801 | GA | 35 | 61 | 1186 | 13.9 | 1.2 | 1.5 | ○ | ○ |
| 4 | C | 25 | 5.6 | 840 | 796 | GA | 27 | 70 | 1312 | 12.9 | 1.4 | 1.4 | ○ | ○ |
| 5 | C | 46 | −1.2 | 840 | 796 | GA | 31 | 65 | 1265 | 13.5 | 1.3 | 2.1 | X | ○ |
| 6 | D | 17 | 11.0 | 820 | 777 | GI | 30 | 67 | 1250 | 13.5 | 1.5 | 1.5 | ○ | ○ |
| 7 | E | 33 | 0.9 | 850 | 805 | GI | 37 | 60 | 1170 | 14.4 | 1.3 | 1.9 | ○ | ○ |
| 8 | F | 17 | −0.8 | 840 | 820 | GI | 40 | 58 | 1310 | 14.1 | 1.1 | 2.2 | X | ○ |
| 9 | G | 25 | −2.6 | 880 | 819 | GI | 37 | 53 | 1256 | 12.1 | 1.4 | 2.1 | X | ○ |
| 10 | H | 33 | 6.0 | 850 | 788 | GI | 21 | 77 | 1380 | 12.9 | 1.1 | 1.7 | ○ | ○ |
| 11 | I | 33 | 20.1 | 770 | 754 | GI | 42 | 51 | 1284 | 8.8 | 2.3 | 1.6 | X | X |
| 12 | J | 25 | 4.1 | 830 | 792 | GI | 65 | 25 | 910 | 19.4 | 1.4 | 3.5 | ○ | ○ |
| 13 | K | 33 | −0.7 | 830 | 808 | GI | 39 | 58 | 1230 | 13.3 | 1.2 | 2.6 | X | ○ |
| 14 | L | 42 | 0.3 | 850 | 801 | GI | 41 | 58 | 1285 | 12.1 | 1.6 | 1.8 | ○ | ○ |
| 15 | M | 37 | −2.9 | 830 | 809 | GI | 42 | 53 | 1292 | 12.5 | 1.3 | 2.2 | X | ○ |
| 16 | N | 25 | 9.9 | 830 | 780 | GI | 35 | 62 | 1243 | 13.7 | 1.6 | 1.5 | ○ | ○ |
| 17 | O | 33 | 5.3 | 820 | 794 | GA | 27 | 63 | 1332 | 13.1 | 1.5 | 1.4 | ○ | ○ |
| 18 | P | 17 | 10.4 | 810 | 785 | GA | 38 | 61 | 1312 | 13.2 | 1.7 | 1.4 | ○ | ○ |
| 19 | Q | 38 | 6.3 | 840 | 792 | GA | 17 | 82 | 1487 | 12.4 | 1.4 | 1.4 | ○ | ○ |
| 20 | R | 33 | 7.1 | 850 | 787 | GA | 25 | 72 | 1243 | 13.5 | 1.3 | 1.5 | ○ | ○ |
| 21 | R | 49 | 1.0 | 850 | 787 | GA | 27 | 70 | 1237 | 13.9 | 1.2 | 1.8 | ○ | ○ |
| 22 | R | 54 | −1.9 | 850 | 787 | GA | 32 | 64 | 1217 | 14.0 | 1.2 | 2.2 | X | ○ |
| 23 | S | 42 | 8.2 | 840 | 773 | GA | 12 | 87 | 1290 | 13.5 | 1.3 | 1.2 | ○ | ○ |
| 24 | S | 33 | 11.1 | 910 | 773 | GA | 12 | 60 | 1212 | 13.4 | 1.1 | 2.4 | X | ○ |
| 25 | T | 50 | −1.5 | 830 | 796 | GA | 47 | 43 | 1021 | 19.8 | 1.1 | 3.3 | X | ○ |
| 26 | U | 33 | 0.4 | 870 | 804 | GA | 33 | 58 | 1036 | 18.6 | 2.1 | 1.9 | X | X |
| 27 | V | 17 | 3.1 | 830 | 806 | GA | 40 | 58 | 1283 | 13.9 | 1.2 | 1.7 | ○ | ○ |
| 28 | V | 25 | 1.4 | 830 | 806 | GA | 41 | 56 | 1269 | 14.2 | 1.2 | 1.8 | ○ | ○ |
| 29 | W | 33 | −0.5 | 840 | 808 | GA | 32 | 64 | 1254 | 13.2 | 1.4 | 2.4 | X | ○ |
| 30 | X | 42 | 3.1 | 820 | 786 | GA | 32 | 61 | 1238 | 14.3 | 1.3 | 1.7 | ○ | ○ |

*1 GI: Hot-dip galvanizing, GA: Alloyed hot-dip galvanizing

First, in all the steel sheets of Nos. 1, 3, 4, 6, 7, 10, 14, 16-21, 23, 27, 28, 30, because the componential composition and the manufacturing condition satisfied the requirements stipulated in the present invention, 1,100 MPa or above ultra-high-strength steel sheets excellent in hydrogen embrittlement resistance and bending workability were obtained.

On the other hand, the steel sheets of Nos. 2, 5, 8, 9, 11-13, 15, 22, 24-26, 29 were the examples in which any of the strength, hydrogen embrittlement resistance or bending workability was inferior, because either the componential composition or the manufacturing condition deviated from those stipulated in the present invention.

More specifically, in the steel sheet No. 2, because the soaking temperature was below $A_{C1}$+50° C., recrystallization did not progress sufficiently, the aspect ratio of ferrite grains became high, and both hydrogen embrittlement resistance and bending workability deteriorated.

In the steel sheets of Nos. 5, 8, 9, 15, 29, because cold rolling was performed with the value X being below 0, recrystallization progressed, the grain diameter of ferrite became large, and hydrogen embrittlement resistance deteriorated.

The steel sheet No. 11 was an example in which the steel kind I with low Si content was used, the effect of inhibiting generation of cementite was not exerted sufficiently, and hydrogen embrittlement resistance and bending workability deteriorated.

The steel sheet No. 12 was an example using the steel kind J with low Mn content, and the strength deteriorated.

The steel sheet No. 13 used the steel kind K not containing Ti and cold rolling was performed with the value X being below 0, therefore recrystallization of ferrite progressed, the grain diameter of ferrite became large, and hydrogen embrittlement resistance deteriorated.

The steel sheet No. 22 was an example in which cold rolling was performed with high cold rolling ratio and with the value X being below 0, recrystallization of ferrite progressed, the grain diameter of ferrite became large, and hydrogen embrittlement resistance deteriorated.

In the steel No. 24, because the soaking temperature was high, austenite grains became coarse, ferrite grains became large, and hydrogen embrittlement resistance deteriorated.

The steel sheet No. 25 was an example in which cold rolling was performed with the value X being below 0, recrystallization of ferrite progressed, ferrite grains became large, and hydrogen embrittlement resistance deteriorated.

The steel sheet No. 26 was an example using the steel kind U of large total content of Ti and V and low Mn content, the aspect ratio of ferrite became high, hydrogen embrittlement resistance and bending workability deteriorated, and the strength also lowered.

In the present examples, the results of the hot-dip galvanized steel sheets and alloyed hot-dip galvanized steel sheets performed with galvanizing after cold rolling are exhibited, however, it has been confirmed that similar results are also obtained with respect to the cold rolled steel sheets not performed with galvanizing.

What is claimed is:

1. A steel sheet, comprising

C: 0.05-0.25%;

Si: 1.00-2.5%;

Mn: 2.0-4.0%;

P: 0.1% or below;

S: 0.05% or below;
Al: 0.01-0.15%;
Ti: 0.003-0.10%;
N: 0.01% or below; and
the balance comprising iron with inevitable impurities, wherein:
% means mass %;
the steel sheet is a composite structure steel sheet comprising ferrite and martensite;
ferrite is 10-50 area % and martensite is 50 area % or above;
the average circle-equivalent grain diameter of ferrite grains is 2.0 μm or below and the average aspect ratio of ferrite grains is 2.0 or below; and
the tensile strength is 1,100 MPa or above.

2. The steel sheet of claim 1, further comprising at least one of:
Nb: 0.003-0.20%; and
V: 0.003-0.20%,
wherein a total content of Ti, Nb and V is 0.25% or below.

3. The steel sheet of claim 1, further comprising at least one element selected from a group consisting of:
Cu: 0.01-1.0%;
Ni: 0.01-1.0%; and
Cr: 0.01-1.0%.

4. The steel sheet of claim 1, further comprising at least one of:
Mo: 0.01-1.0%; and
W: 0.01-1.0%.

5. The steel of sheet of claim 1, further comprising B: 0.0001-0.005%.

6. The steel sheet of claim 1, further comprising at least one element selected from a group consisting of:
Ca: 0.0005-0.005%;
Mg: 0.0005-0.005%; and
REM: 0.0005-0.005%.

7. The steel sheet of claim 1, wherein the steel sheet is hot-dip galvanized or alloyed hot-dip galvanized.

8. The steel sheet of claim 1, comprising:
P: greater than or equal to 0.006% to less than or equal to 0.022%.

9. A method for manufacturing the steel sheet of claim 1, the method comprising:
(a) cold rolling a hot rolled steel sheet so that X expressed by an equation (I) satisfies X≧0 and a cold rolling ratio CR(%) becomes CR<50%;

$$X = 20\left([\mathrm{Ti}] + \frac{[\mathrm{Nb}]}{2} + \frac{[\mathrm{V}]}{4}\right) - 9[\mathrm{Si}] + 7[\mathrm{Mn}] + 10 - 2.7 \times 2^{\frac{CR}{20}}; \quad \text{(I)}$$

and
(b) soaking after the cold rolling at ($A_{C1}$+50)° C. to 900° C.,
wherein:
in equation (I), [Ti], [Nb], [V], [Si], [Mn] respectively represent content (mass %) of each element; and
the hot rolled steel sheet comprises:
C: 0.05-0.25%;
Si: 1.00-2.5%;
Mn: 2.0-4.0%;
P: 0.1% or below;
S: 0.05% or below;
Al: 0.01-0.15%;
Ti: 0.003-0.10%;
N: 0.01% or below; and
iron with inevitable impurities, wherein % means mass %.

* * * * *